US006575295B2

(12) United States Patent
Mayfield

(10) Patent No.: US 6,575,295 B2
(45) Date of Patent: Jun. 10, 2003

(54) PAINT BRUSH BRISTLE COVER

(76) Inventor: Marlon E. Mayfield, P.O. Box 13687, Tallahassee, FL (US) 32317

( * ) Notice: Subject to any disclaimer, the term of this patent is extended or adjusted under 35 U.S.C. 154(b) by 26 days.

(21) Appl. No.: 09/951,002

(22) Filed: Sep. 14, 2001

(65) Prior Publication Data

US 2003/0052026 A1 Mar. 20, 2003

(51) Int. Cl.[7] ..... B65D 75/14; B65D 5/50
(52) U.S. Cl. ..... 206/15.3; 206/362.4
(58) Field of Search ..... 206/361, 362.3, 206/15.2, 15.3, 362.4, 805, 784; 220/697; 229/112

(56) References Cited

U.S. PATENT DOCUMENTS 2,609,920 A * 9/1952 Ringler ..... 206/362.4
3,136,409 A * 6/1964 Schumann ..... 206/361
3,981,399 A * 9/1976 Crouch ..... 206/15.2
4,606,456 A * 8/1986 Kaminski ..... 206/362.4
4,847,939 A * 7/1989 Derencsenyi et al. ..... 15/246
5,191,973 A * 3/1993 Shteynberg ..... 206/15.2
5,363,959 A * 11/1994 Crosby et al. ..... 206/362.4
5,465,453 A * 11/1995 Landmeier ..... 15/247
5,645,167 A * 7/1997 Conrad ..... 206/361
5,791,608 A * 8/1998 Nielsen et al. ..... 248/110

* cited by examiner

*Primary Examiner*—Jacob K. Ackun
(74) *Attorney, Agent, or Firm*—John Wiley Horton

(57) ABSTRACT

A paint brush protecting cover using a series of folding flaps. The flaps are connected in such a way that, when folded, they force the bristles into the desired tapered configuration. The invention's primary advantage lies in its method of closure: Two elastic bands are affixed to one of the flaps. The user simply passes these bands around the folded device, thereby securing it to the paint brush. The elastic bands place a small compressive force on the brush and bristles, helping to keep the bristles in the proper orientation. The elastic nature of the closure method also allows the device to accommodate a wide variety of brushes.

15 Claims, 9 Drawing Sheets

PAINT BRUSH BRISTLE COVER

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of paint brushes. More specifically, the invention comprises a removable cover which locks over a paint brush to properly align the paint brush bristles while the brush is not in use. The cover is designed to slightly compress the bristles and hold them in the proper orientation so that they remain in the desired shape over extended use.

2. Description of the Related Art

Paint brush sleeves and holders have been in common use for decades. A simple hanging sleeve is disclosed in U.S. Pat. No. 3,136,409 to Schuman (1964). It discloses a clear plastic sleeve which fits over a paint brush's bristle and allows the brush to be hung in an inverted position. The inverted position often accelerates bristly drying. In such a configuration, however, the bristles have a tendency to splay—since they are heaviest when wet. A similar inverted hanging sleeve is disclosed in U.S. Pat. No. 3,426,989 to Dgetluck (1969). The reader will note that both sleeves must be carefully sized to fit a particular brush. They are not adaptable to a variety of brushes.

U.S. Pat. No. 3,981,399 to Crouch (1976) discloses a bristle protector designed to hold a paint brush with its bristles facing downward. The Crouch device also incorporates walls which press against the bristles during the drying process, thereby tending to force the bristles into the desired shape. The device holds the bristles well, but it is quite complicated—requiring several interacting parts. It also must be carefully sized to fit a particular brush.

Another type of bristle sleeve is disclosed in U.S. Pat. No. 4,847,939 to Derencsenyi et al. (1989). The '939 device discloses a pliable sleeve intended to slip over the brush. An undercut section engages the metal stock (given the number "22" in the disclosure) to hold itself in place. As this is a sliding frictional fit, the device must be very closely sized to fit a particular brush. It would not function for an identically-sized brush made by another manufacturer—since the shape and thickness of the metal stock tends to vary from brush to brush. It also fails to compress the bristles into the desired tapered shape.

Several more recent inventions have enclosed paint brushes using folding flaps. One example of this approach is shown in U.S. Pat. No. 5,465,453 to Landmeier (1995). The Landmeier device uses folding flaps secured over the bristles by a latching mechanism. Vent holes are provided to aid drying. A similar but more sophisticated design is shown in U.S. Pat. No. 5,191,973 to Shteynberg (1993). The Shteynberg design uses locking snaps to hold the bristle cover in place.

U.S. Pat. No. 5,363,959 to Crosby et al. (1994) discloses a bristle cover made from folding panels. The panels are secured in place using several interlocking tabs and slits (thereby eliminating the need for separate fasteners). While effective, the Crosby device is difficult to assemble, in that the user must place a minimum of three tabs in three slots to secure the device on the paint brush.

A folding plastic case is disclosed in U.S. Pat. No. 5,645,167 to Conrad (1997). Basically a clamshell design, the Conrad device locks over a paint brush using plastic snap latches. Because it is substantially rigid, however, it has difficulty accommodating variation in paint brush widths and thicknesses.

Accordingly, the prior art devices are limited in that they:

1. Are cumbersome to apply to a paint brush;
2. Do not accommodate variations in paint brush size; and
3. Do not hold the bristles in the desired tapered configuration.

BRIEF SUMMARY OF THE INVENTION

The present invention encapsulates a paint brush—including its bristles—using a series of folding flaps. The flaps are connected in such a way that, when folded, they force the bristles into the desired tapered configuration. The invention's primary advantage lies in its method of closure: Two elastic bands are affixed to one of the flaps. The user simply passes these bands around the folded device, thereby securing it to the paint brush. The elastic bands place a small compressive force on the brush and bristles, helping to keep the bristles in the proper orientation. The elastic nature of the closure method also allows the device to accommodate a wide variety of brushes.

Accordingly, the present invention seeks to provide a paint brush bristle cover which:

1. Is easy to apply to a paint brush;
2. Can accommodate variations in paint brush size; and
3. Holds the bristles in the desired tapered configuration.

REFERENCE NUMERALS IN THE DRAWINGS

| | |
|---|---|
| 10 paint brush | 12 handle |
| 14 bristles | 16 shank portion |
| 18 bristle cover | 20 back panel |
| 22 second side panel | 24 first side panel |
| 26 top panel | 28 first lock slot |
| 30 top flap | 32 second front flap |
| 34 first front flap | 36 cover flap |
| 38 first side fold | 40 second side fold |
| 42 third side fold | 44 fourth side fold |
| 46 first top fold | 48 second top fold |
| 50 first bottom fold | 52 second bottom fold |
| 54 handle hole | 56 mounting hole |
| 58 first strap body | 60 second strap body |
| 62 first strap | 64 second strap |
| 66 vent | 68 stock |
| 70 second side | 72 bottom |
| 74 first side | 76 top |
| 78 front | 80 back |

DETAILED DESCRIPTION OF THE INVENTION

Figure 1:
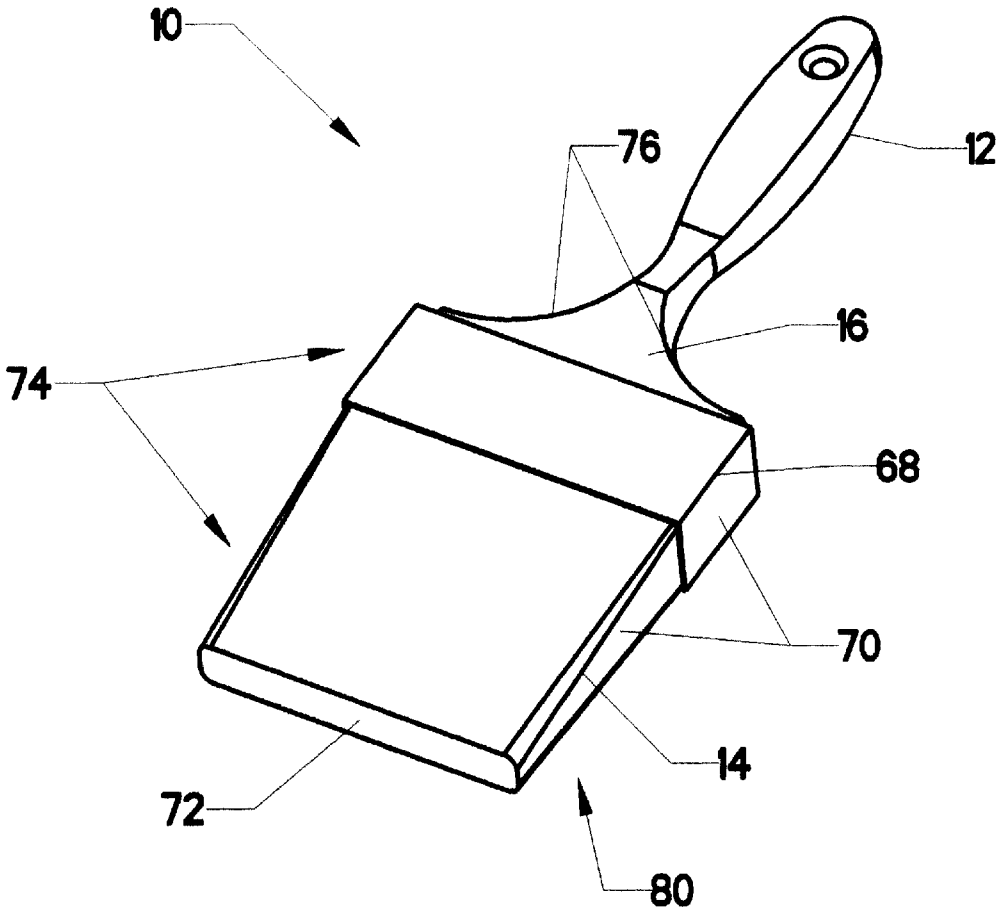
FIG. 1 (PRIOR ART)
FIG. 1 is an isometric view, showing a typical paint brush.

FIG. 1 shows paint brush 10. Handle 12 comprises the top portion of paint brush 10. It terminates in shank portion 16, which fits within stock 68. Stock 68 is an assembly which joins bristles 14 to shank portion 16. The combination of shank portion 16, stock 68, and bristles 14 makes up the lower assembly of brush 10. The reader will note that this lower assembly is generally rectangular in shape. It has generally planar surfaces (made up of the flat faces on stock 68 and bristles 14). These surfaces may be referred to as front 78, back 80 (facing away from the viewer in FIG. 1), first side 74, second side 70, bottom 72, and top 76. Of course, top 76 is not a planar surface. It consists of the upward facing and curving surfaces of shank portion 16.

Professional painters typically purchase expensive paint brushes intended to be used over long periods. The brushes are continually used, cleaned, and hung up to dry. It is very important that bristles 14 be maintained in good condition. The handle and stock portions of the brush can last indefinitely. Thus, it is the life of the bristles that determines the service life of a paint brush.

FIG. 1 illustrates how the bristles are ideally set in a tapered configuration and grouped tightly together. Repeated washing and drying cycles often cause the bristles to splay, ultimately ruining the paint brush. Thus, it is very important to hold the bristles in the correct position during the drying process. The inventor has discovered that the bristles are best preserved by hanging the brush with its handle facing upwards. This results in gravity pulling the wet bristles straight down. An added element is needed, however, to prevent splaying and to provide the desired taper. The present invention adds this needed element.

Figure 2:
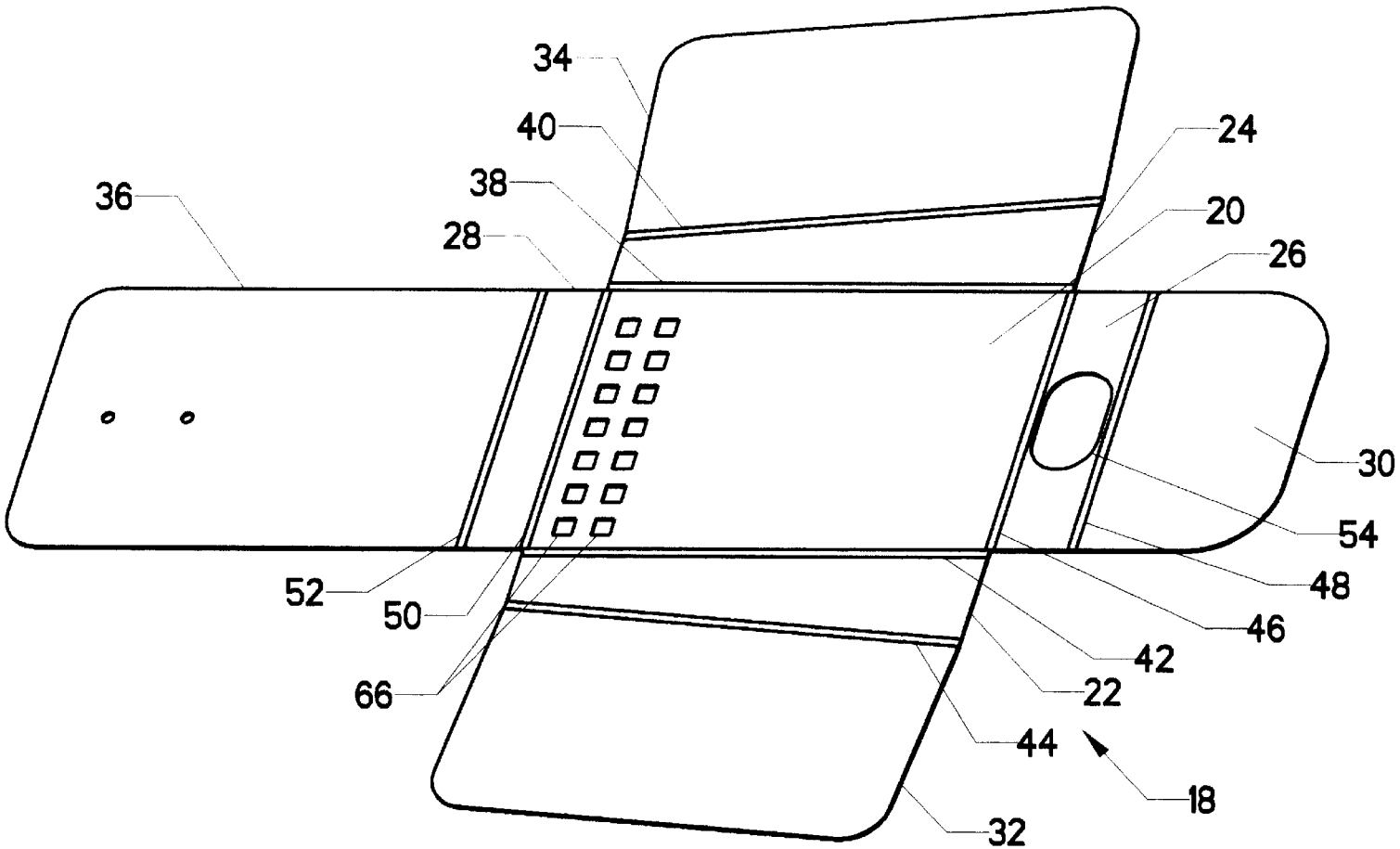
FIG. 2 is an isometric view, showing the present invention in an unfolded state.

FIG. 2 illustrates bristle cover 18 in a flattened state. Bristle cover 18 is ideally made from thin and flexible material which can be folded into the desired shapes. It is also desirable to employ a water and solvent proof material, since it will inevitably come in contact with water, soap, and mineral spirits used to clean paint brushes. Thin plastic sheeting has been found to be particularly effective.

Back panel 20 is the central element. Top panel 26 is connected to back panel 20 along first top fold 46. It is convenient to consider these features as they are oriented in space when the device is attached to a hanging brush (hanging by its handle). Thus, top panel 26 attaches to what will be the top boundary of back panel 20 when it is placed on a hanging brush (see FIG. 3 for its orientation with respect to a brush).

Top panel 26 opens into handle hole 54. This hole is sized to allow the passage of handle 12, but not shank portion 16. Top flap 30 is connected to top panel 26 along second top fold 48. Each of the folds allows the attached panels to reversibly bend with respect to one another. The folds can be created using a series of stitched cuts to weaken the thin plastic material at that point. They can also be created by placing the flat sheet in a mechanical press brake. As these processes are well understood in the prior art, they have not been illustrated.

Bottom panel 28 connects to back panel 20 along first bottom fold 50. Cover flap 36 attaches to bottom panel 28 along second bottom fold 52. First side panel 24 attaches to back panel 20 along first side fold 38. First front flap 34 attaches to first side panel 24 along second side fold 40. Likewise, second side panel 22 attaches to back panel 20 along third side fold 42. Second front flap 32 attaches to second side panel 22 along fourth side fold 44.

Figure 3:
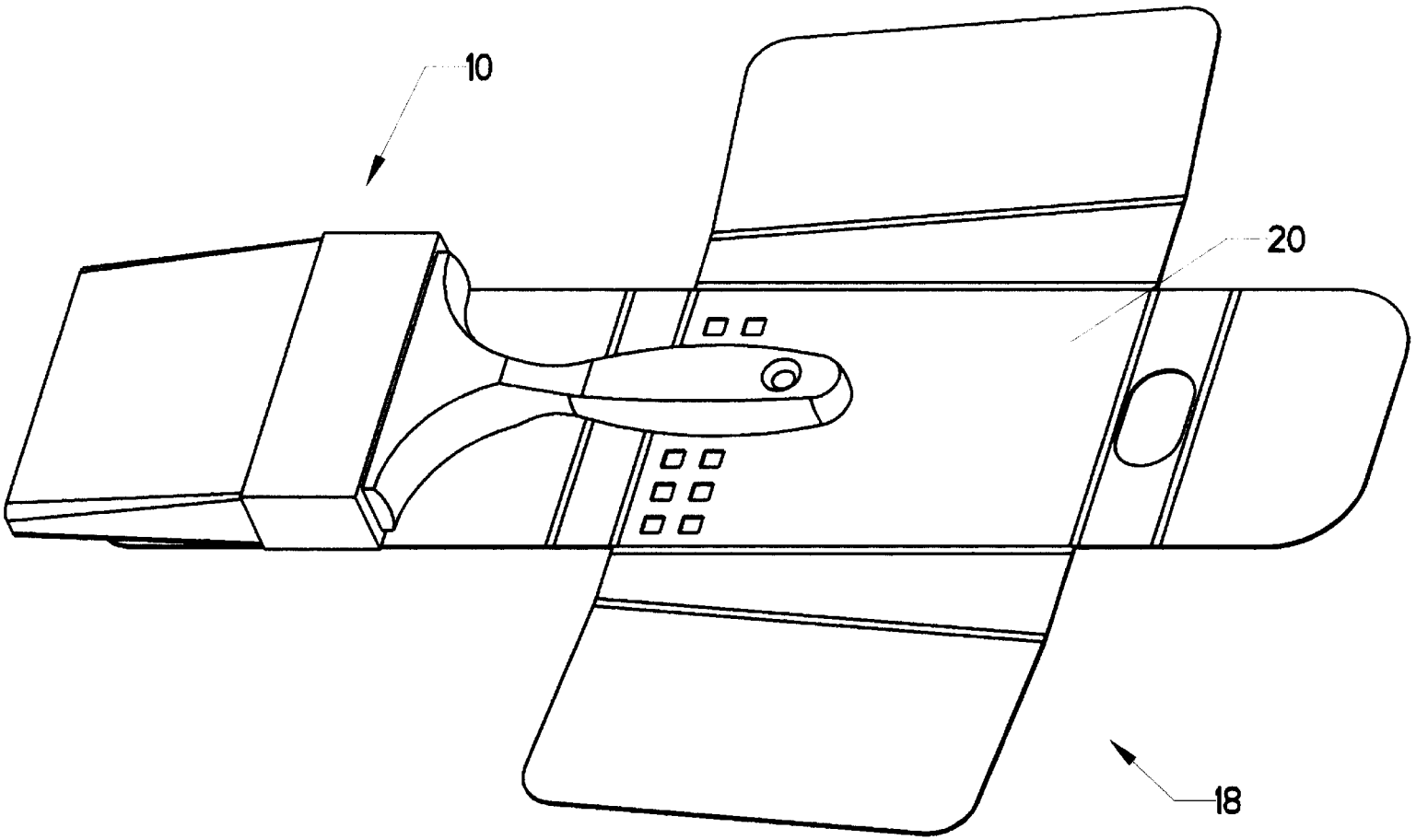
FIG. 3 is an isometric view, showing the present invention being applied to a paint brush.
Figure 4:
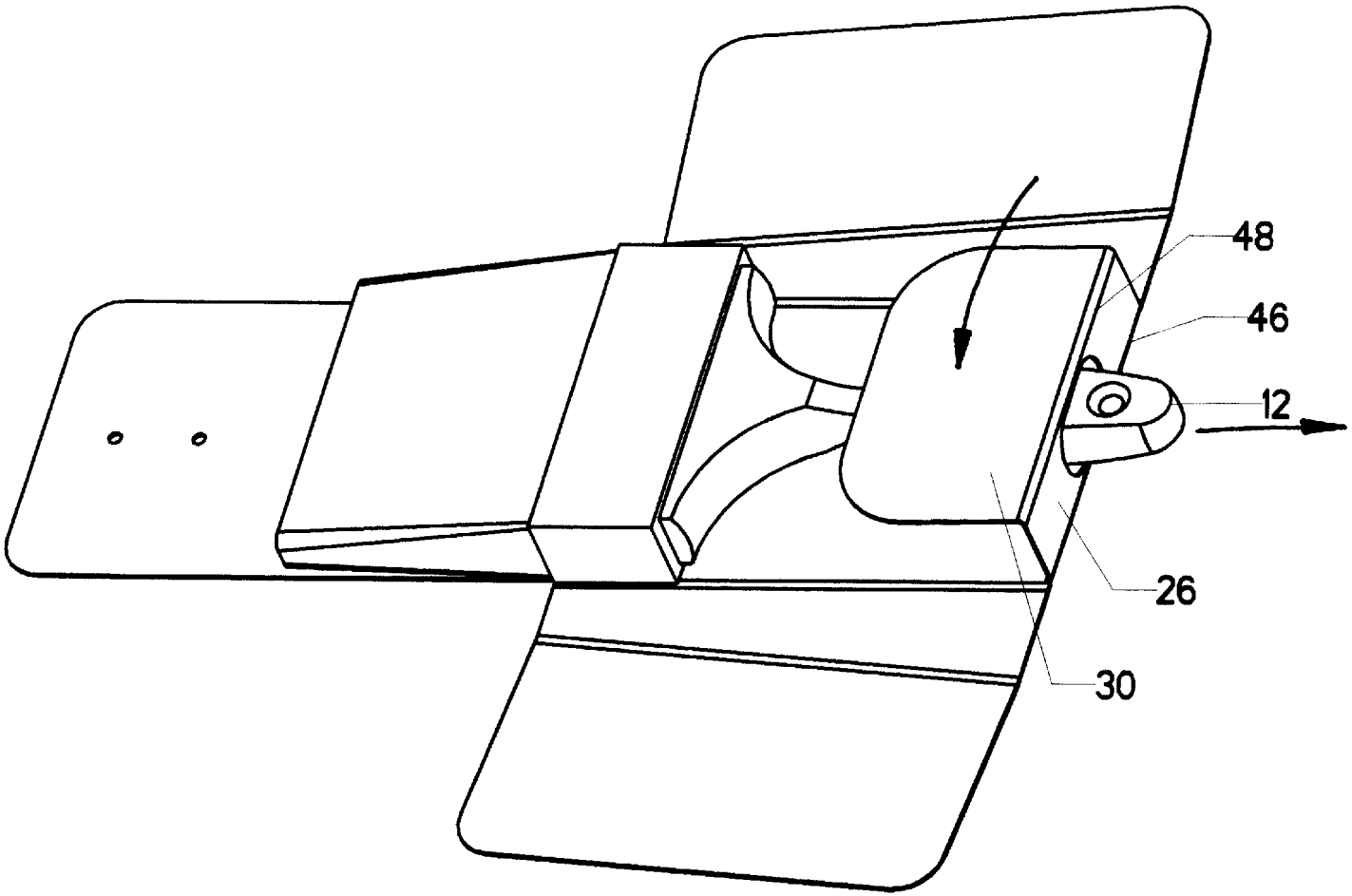
FIG. 4 is an isometric view, showing the second step in attaching the present invention to a paint brush.
Figure 5:
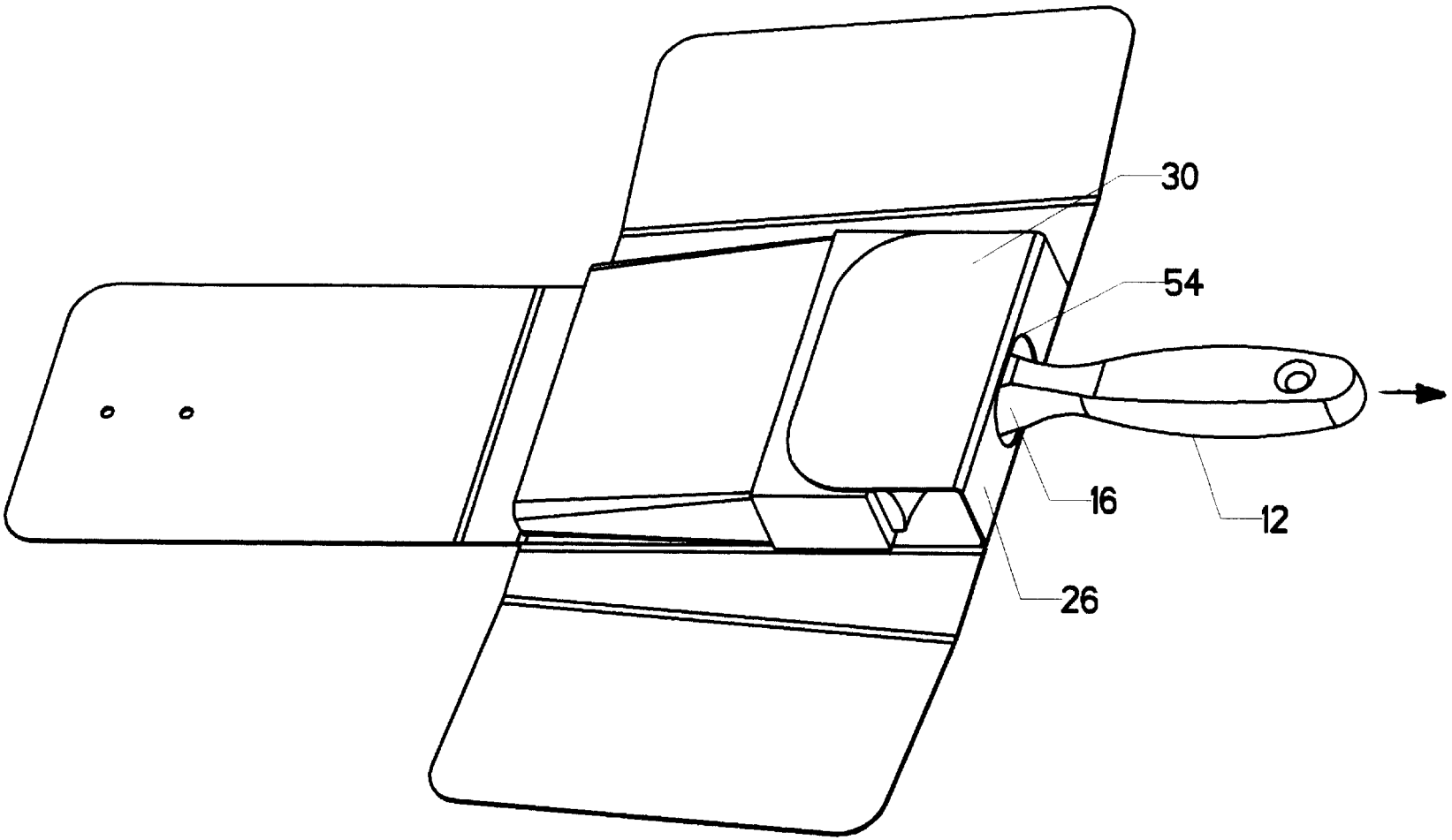
FIG. 5 is an isometric view, showing the third step in attaching the present invention to a paint brush.

The folded structure of bristle cover 18 is best understood with respect to paint brush 10. Turning now to FIG. 3, the application of bristle cover 18 to paint brush 10 will be explained. Paint brush 10 is place on bristle cover 18, with back 80 lying in the same plane as back panel 20. Turning now to FIG. 4, top panel 26 and top flap 30 are folded as shown, along first top fold 46 and second top fold 48. Handle 12 is then inserted through handle hole 54, as indicated by the arrow. FIG. 5 shows the position of paint brush 10 after shank portion 16 has arrested its further progress through handle hole 54. At this point, the inner facing surface of top panel 26 is resting against top 76 of paint brush 10. The inner surface of top flap 30 is likewise resting against front 78 of paint brush 10.

Figure 6:
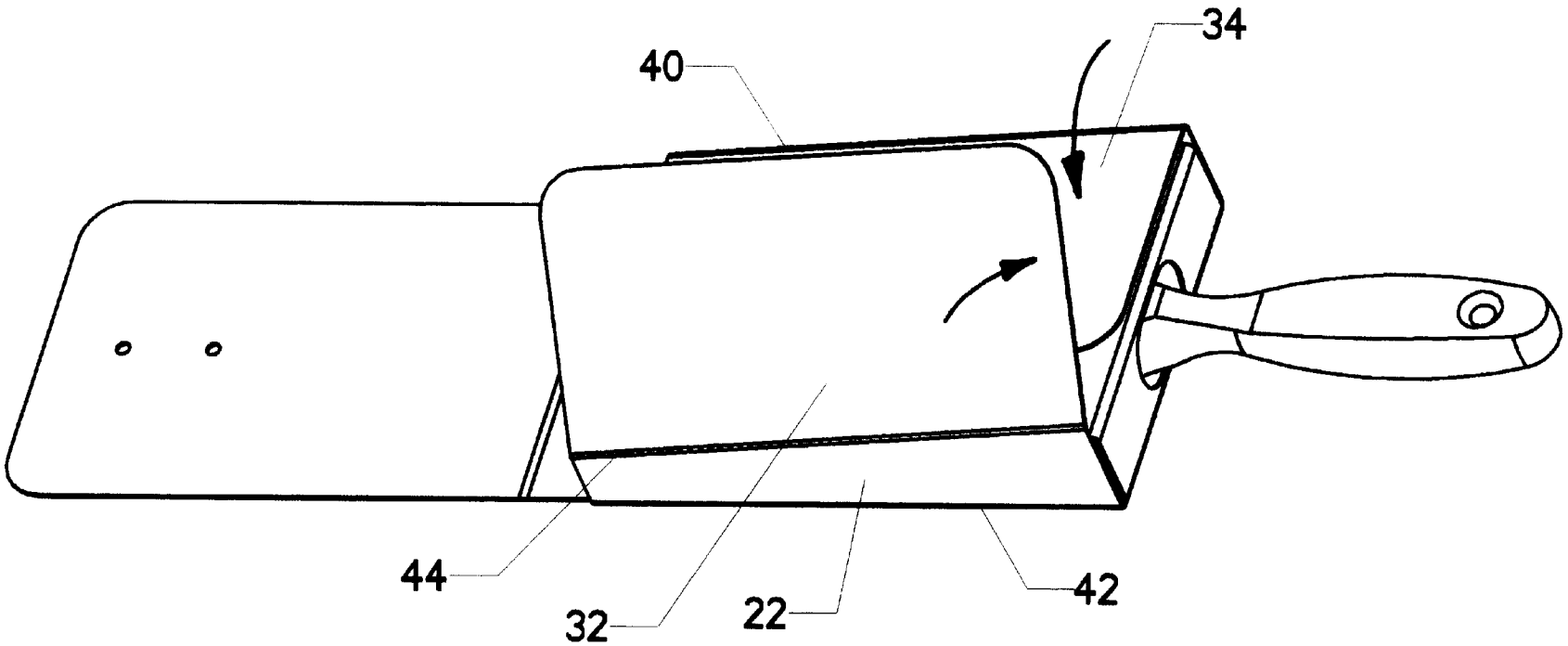
FIG. 6 is an isometric view, showing the fourth step in attaching the present invention to a paint brush.
Figure 7:
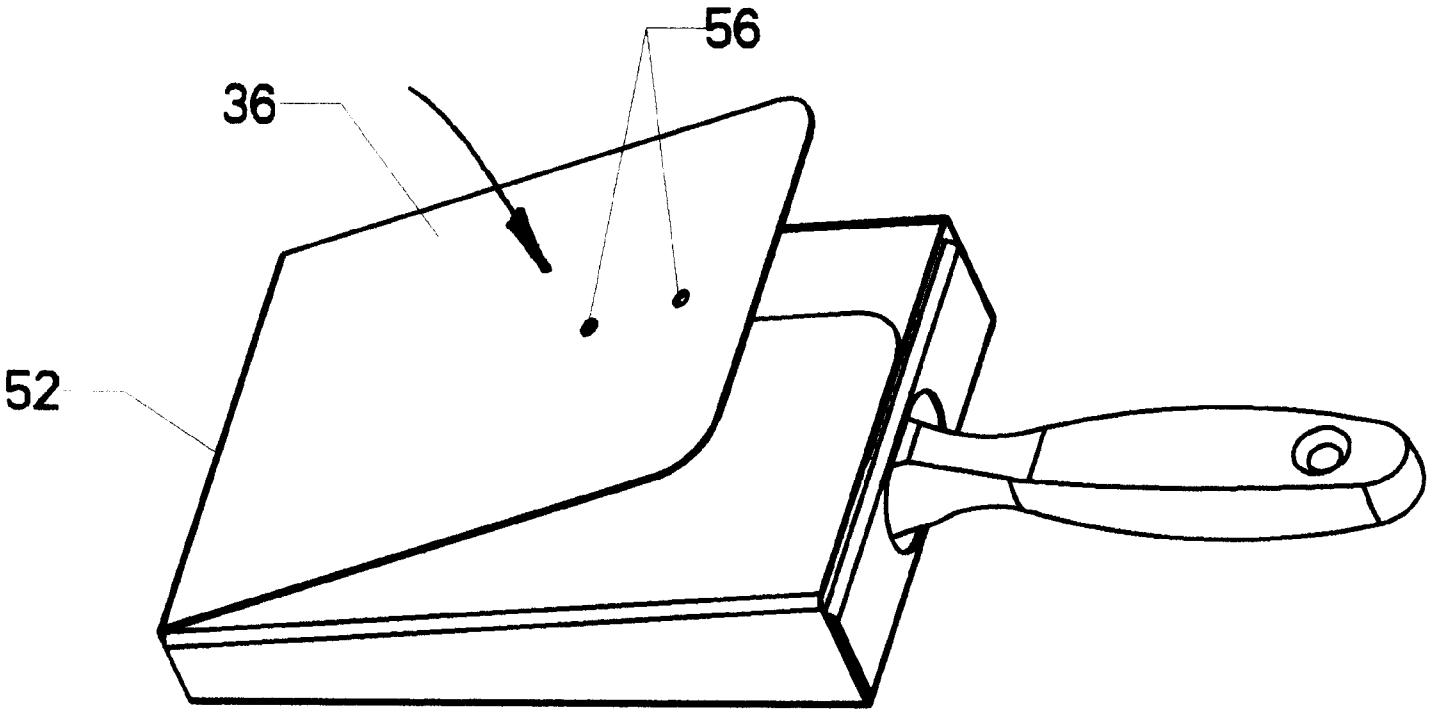
FIG. 7 is an isometric view, showing the fifth step in attaching the present invention to a paint brush.

In FIG. 6, first side panel 24, second side panel 22, first front flap 34, and second front flap 32 are folded over as shown. The two side panels rest against the sides of paint brush 10. The two front flaps fold over top flap 30. In FIG. 7, bottom panel 28 and cover flap 36 are folded over as shown. The lower assembly of paint brush 10 is thereby completely encapsulated. It is necessary, however, to hold the various panels in the folded condition shown. The reader will observe that cover flap 36 is pierced by two mounting holes 56.

Figure 8:
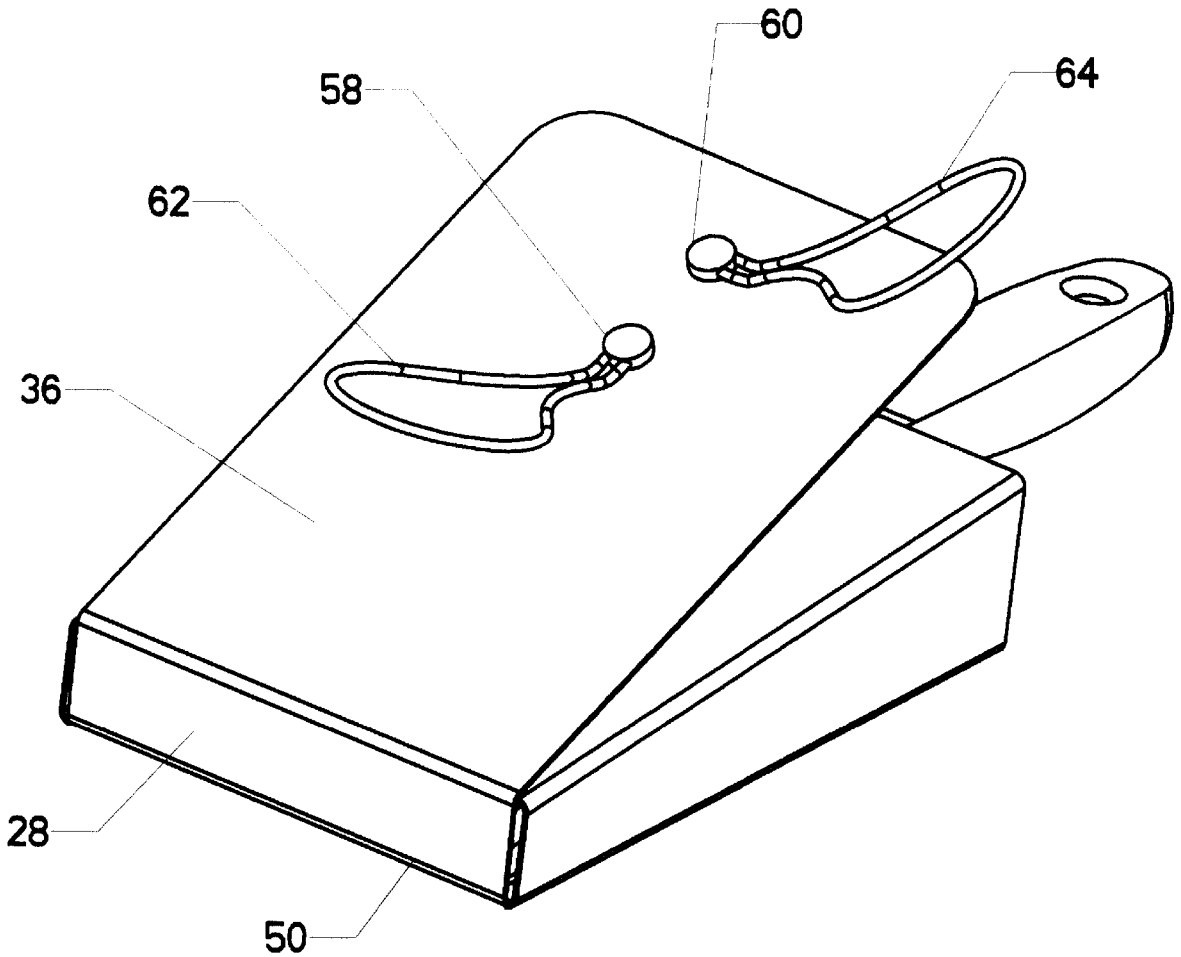
FIG. 8 is an isometric view, showing the addition of the elastic securing straps.

Turning now to FIG. 8, the reader will observe that first strap body 58 and second strap body 60 are snapped into mounting holes 56 (or alternatively glued or attached by other conventional means). First strap body 58 has first strap 62 attached in a loop. First strap 62 is made of a strong and highly elastic material. A user can easily grab and stretch the loop around bristle cover 18. Second strap 64 is identical, except that it is attached to second strap body 60.

When the user desires to secure bristle cover 18 in place, he or she grasps second strap 64 and pulls it around bristle cover 18 in a horizontal orientation (with reference to the brush being suspended in a handle-up orientation).. The user next grasps first strap 62 and pulls it around bristle cover 18 in a vertical orientation. The result is that the various panels comprising bristle cover 18 are urged tightly against the lower assembly of paint brush 10. While a particular size of bristle cover 18 must be created to fit a general class of paint brushes (such as 2 inch, 3 inch, etc.), many different variations can be accommodated through the use of the elastic closure method.

Figure 9:
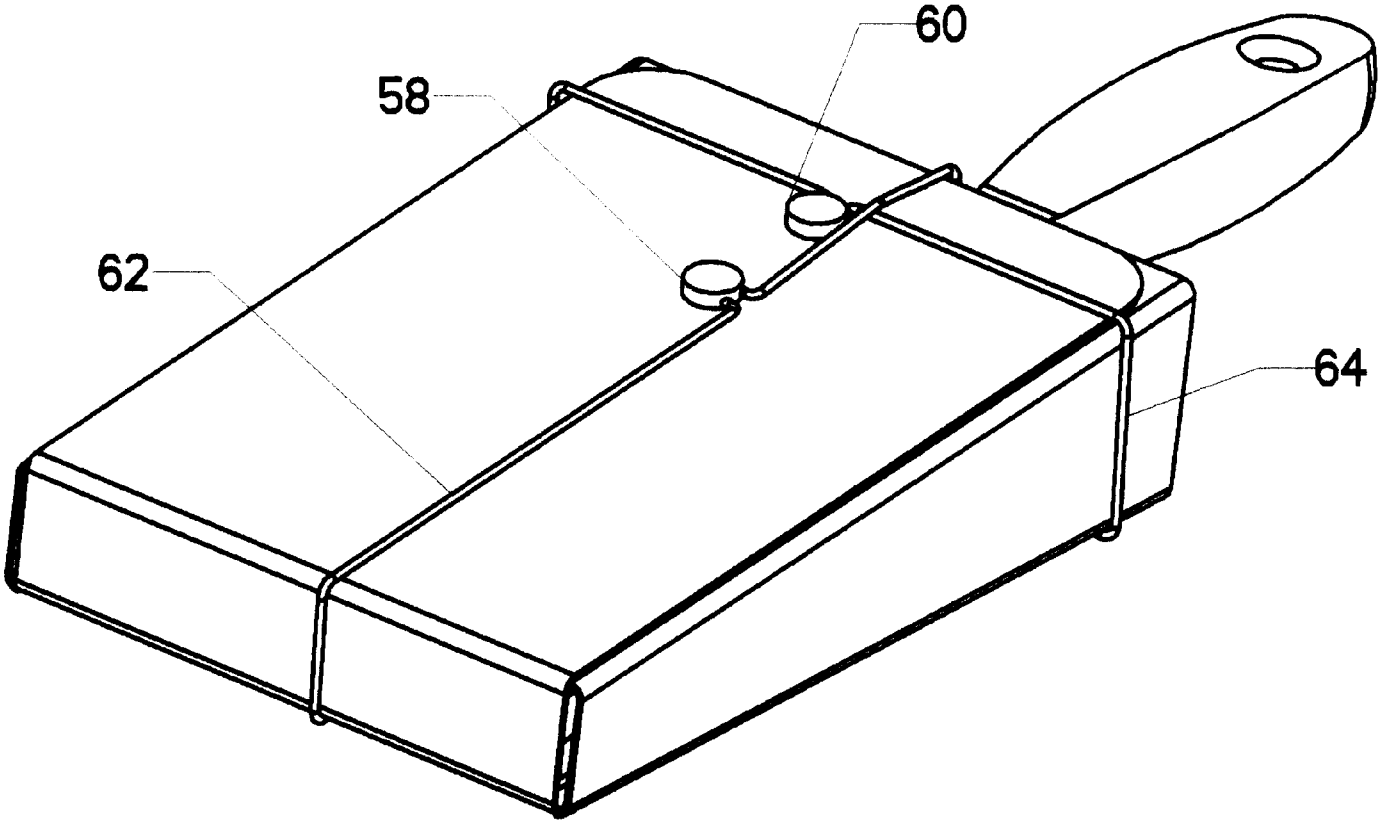
FIG. 9 is an isometric view, showing the elastic securing straps stretched over the cover.

The reader will also observe in FIG. 9 that the two side panels are tapered from top to bottom. This shape results in the proper compression of the bristles. The taper in the side panels may also be readily observed in FIG. 2.

Returning briefly to FIG. 1, the reader will observe a plurality of vents 66 placed in the panels. These vents speed the drying process. They are regarded as an optional feature, since some applications require that the brush remain wet (and rapid drying is therefore undesirable). Most applications, however, make rapid drying an advantage. Thus, the version with the vents is considered the preferred embodiment.

Although the device has been illustrated as starting out flat, this would not be the typical method of use. The device would normally have the folds already formed. It would then be necessary for the user to unfold the device to insert a paint brush. The user would not need to unfold it to the flat state. Instead, he or she would only need to unfold it enough to insert the handle into handle hole 54 and guide the lower assembly against back panel 20. Once the brush is inserted the device has a natural tendency to refold itself. The user need only gently push the panels in place before wrapping the elastic straps around to secure it.

Accordingly, the reader will appreciate that the proposed invention provides a bundling strap which:

1. Is easy to apply to a paint brush;
2. Can accommodate variations in paint brush size; and
3. Holds the bristles in the desired tapered configuration.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A paint brush bristle holder allowing a user to cover a paint brush, wherein said paint brush comprises a handle and a lower assembly, wherein said lower assembly includes a shank portion, a stock, and a plurality of bristles, and wherein said lower assembly has a front, back, top, first side, second side, and bottom, comprising:

a. a back panel, being substantially rectangular, and having a top boundary, a first side boundary, a second side boundary, and a bottom boundary;

b. a top panel, being substantially rectangular, and having a top boundary, a first side boundary, a second side boundary, and a bottom boundary, wherein said bottom boundary of said top panel is foldably affixed to said top boundary of said back panel, and wherein said top panel opens into a handle hole passing completely therethrough;

c. a top flap, being substantially rectangular, and having a top boundary, a first side boundary, a second side boundary, and a bottom boundary, wherein said bottom boundary of said top flap is foldably affixed to said top boundary of said top panel;

d. a first side panel, having a top boundary, a first side boundary, a second side boundary, and a bottom boundary, wherein said first side boundary of said first side panel is foldably affixed to said first side boundary of said back panel;

e. a first front flap, being substantially rectangular, and having a top boundary, a first side boundary, a second side boundary, and a bottom boundary, wherein said first side boundary of said first front flap is foldably affixed to said second side boundary of said first side panel;

f. a second side panel, having a top boundary, a first side boundary, a second side boundary, and a bottom boundary, wherein said first side boundary of said second side panel is foldably affixed to said second side boundary of said back panel;

g. a second front flap, being substantially rectangular, and having a top boundary, a first side boundary, a second side boundary, and a bottom boundary, wherein said first side boundary of said second front flap is foldably affixed to said second side boundary of said second side panel;

h. a bottom panel, being substantially rectangular, and having a top boundary, a first side boundary, a second side boundary, and a bottom boundary, wherein said top boundary of said bottom panel is foldably affixed to said bottom boundary of said back panel;

i. a cover flap, being substantially rectangular, and having a top boundary, a first side boundary, a second side boundary, and a bottom boundary, wherein said top boundary of said cover flap is foldably affixed to said bottom boundary of said bottom panel; and j. elastic securing means for securing said paint brush bristle holder to said paint brush after said user places said back panel against said back of said paint brush, folds said top panel against said top of said paint brush, places said handle through said handle hole, folds said first side panel against said first side of said brush, folds said second side panel against said second side of said brush, folds said bottom panel against said bottom of said brush, folds said first front flap over said front of said brush, folds said second front flap over said first front flap, and folds said cover flap over said second front flap.

2. A device as recited in claim 1, wherein said elastic securing means comprises a first elastic strap, formed in the shape of a loop, affixed to an outward facing surface of said paint brush bristle holder, so that after said user has placed said paint brush bristle holder around said paint brush, said user can pass said first elastic strap around said paint brush bristle holder, thereby clamping said paint brush bristle holder securely around said paint brush.

3. A device as recited in claim 2, further comprising a second elastic strap, formed in the shape of a loop, affixed to an outward facing surface of said paint brush bristle holder, so that after said user has placed said paint brush bristle holder around said paint brush, said user can pass said second elastic strap around said paint brush bristle holder, thereby clamping said paint brush bristle holder securely around said paint brush.

4. A device as recited in claim 1 wherein:

a. said top boundary of said first side panel is longer than said bottom boundary of said first side panel, so that said first side panel is formed in the shape of a trapezoid; and b. said top boundary of said second side panel is longer than said bottom boundary of said second side panel, so that said second side panel is formed in the shape of a trapezoid.

5. A device as recited in claim 1, wherein said back panel opens into at least one vent passing completely therethrough.

6. A device as recited in claim 1, wherein said first side panel opens into at least one vent passing completely therethrough.

7. A device as recited in claim 1, wherein said second side panel opens into at least one vent passing completely therethrough.

8. A device as recited in claim 1, wherein said cover flap opens into at least one vent passing completely therethrough.

9. A paint brush bristle holder allowing a user to cover a paint brush, wherein said paint brush comprises a handle and a lower assembly, wherein said lower assembly includes a shank portion, a stock, and a plurality of bristles, and wherein said lower assembly has a front, back, top, first side, second side, and bottom, comprising:

a. a back panel, dimensioned to cover said back of said lower assembly of said brush;

b. side panels extending from opposite lateral edges of said back panel to be folded around said first side and said second side of said lower assembly and overlappingly cover said front of said lower assembly;

c. top panels extending from a top edge of said back panel to be folded over said top of said lower assembly, and opening into a handle hole passing completely therethrough;

d. bottom panels extending from a bottom edge of said bottom panel to be folded over said bottom of said lower assembly and overlappingly cover said side panels; and e. elastic securing means for securing said paint brush bristle holder to said paint brush after said user folds said side, top, and bottom panels into position.

10. A device as recited in claim 9, wherein said elastic securing means comprises a first elastic strap, formed in the shape of a loop, affixed to an outward facing surface of said paint brush bristle holder, so that after said user has placed said paint brush bristle holder around said paint brush, said user can pass said first elastic strap around said paint brush bristle holder, thereby clamping said paint brush bristle holder securely around said paint brush.

11. A device as recited in claim 10, further comprising a second elastic strap, formed in the shape of a loop, affixed to an outward facing surface of said paint brush bristle holder, so that after said user has placed said paint brush bristle holder around said paint brush, said user can pass said second elastic strap around said paint brush bristle holder, thereby clamping said paint brush bristle holder securely around said paint brush.

12. A device as recited in claim 9 wherein said side panels are dimensioned so that when they are folded around said first side and said second side of said lower assembly and overlappingly cover said front of said lower assembly, the distance between said back panel and said side panels over said front of said lower assembly tapers from top to bottom.

13. A device as recited in claim 9, wherein said back panel opens into at least one vent passing completely therethrough.

14. A device as recited in claim 9, wherein said side panels open into at least one vent passing completely therethrough.

15. A device as recited in claim 9, wherein said bottom panels open into at least one vent passing completely therethrough.

* * * * *